US010502431B2

(12) United States Patent
Lee

(10) Patent No.: US 10,502,431 B2
(45) Date of Patent: Dec. 10, 2019

(54) OVEN AND DOOR ASSEMBLY APPLIED TO THE OVEN

(71) Applicant: SAMSUNG ELECTRONICS CO., LTD., Suwon-si (KR)

(72) Inventor: Dong Ho Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 497 days.

(21) Appl. No.: 14/808,102

(22) Filed: Jul. 24, 2015

(65) Prior Publication Data

US 2016/0033143 A1 Feb. 4, 2016

(30) Foreign Application Priority Data

Aug. 1, 2014 (KR) ..... 10-2014-0098899

(51) Int. Cl.

| | |
|---|---|
| ***F23M 7/00*** | (2006.01) |
| ***F24C 15/00*** | (2006.01) |
| ***F24C 15/04*** | (2006.01) |
| ***F23M 5/00*** | (2006.01) |
| ***F23M 7/04*** | (2006.01) |

(Continued)

(52) U.S. Cl.

CPC ..... *F24C 15/006* (2013.01); *F23M 5/00* (2013.01); *F23M 7/04* (2013.01); *F24C 14/00* (2013.01); *F24C 15/028* (2013.01); *F24C 15/04* (2013.01)

(58) Field of Classification Search

CPC ..... F24C 15/02; F24C 15/28; F24C 15/006; F24C 15/04; F24C 15/024; F23M 7/04; F23M 7/02

See application file for complete search history.

(56) References Cited

U.S. PATENT DOCUMENTS

| | | | |
|---|---|---|---|
| 3,450,126 | A | 6/1969 | Vonderhaar |
| 3,717,138 | A | 2/1973 | Upp |
| 4,023,554 | A | 5/1977 | Katona |

(Continued)

FOREIGN PATENT DOCUMENTS

| | | | |
|---|---|---|---|
| DE | 44 07 084 | A1 | 9/1995 |
| EP | 0 490 774 | A1 | 6/1992 |

(Continued)

OTHER PUBLICATIONS

European Office Action dated Feb. 27, 2017 for European Patent Application No. 15179350.2.

(Continued)

*Primary Examiner* — Jason Lau
(74) *Attorney, Agent, or Firm* — Staas & Halsey LLP

(57) ABSTRACT

An oven and a door assembly are provided. The oven includes a casing, a cooking chamber located inside the casing and having a shape with an open front, and a door assembly having an inner space therein and configured to close and open the open front of the cooking chamber. The door assembly includes a handle member, a shielding member located between the inner plate and a rear side of the door assembly and configured to shield an air flow, an inlet formed in a bottom of the door assembly and configured to allow an inflow of air from outside of the door into the inner space, and an outlet located on top of the door assembly at the rear of the handle member and configured to provide a space to allow air to move outside the door assembly.

20 Claims, 10 Drawing Sheets

(51) Int. Cl.
*F24C 14/00* (2006.01)
*F24C 15/02* (2006.01)

(56) References Cited

U.S. PATENT DOCUMENTS

| | | | | |
|---|---|---|---|---|
| 4,206,338 | A | 6/1980 | Katona | |
| 5,387,258 | A | 2/1995 | Puricelli | |
| 5,441,036 | A * | 8/1995 | Mikalauskas, II | F24C 15/04 126/194 |
| 2006/0219234 | A1 | 10/2006 | Larsen | |
| 2006/0237425 | A1 | 10/2006 | Kim et al. | |
| 2007/0125760 | A1 | 6/2007 | Kim et al. | |
| 2008/0105140 | A1 | 5/2008 | Lee et al. | |
| 2008/0185373 | A1* | 8/2008 | Elkasevic | F24C 15/006 219/394 |
| 2011/0214661 | A1* | 9/2011 | Hyun | F24C 15/006 126/21 A |
| 2016/0033143 | A1 | 2/2016 | Lee | |

FOREIGN PATENT DOCUMENTS

| | | | | |
|---|---|---|---|---|
| EP | 0 947 776 | A2 | 10/1999 | |
| EP | 1566594 | | 8/2005 | |
| EP | 1793174 | | 6/2007 | |
| EP | 2 108 892 | A1 | 10/2009 | |
| GB | 2 013 872 | A | 8/1979 | |
| GB | 2013872 | A * | 8/1979 | F24C 15/024 |
| KR | 10-2006-0104751 | | 10/2006 | |
| KR | 1020090085982 | A | 8/2009 | |
| WO | WO 2007080043 | A1 * | 7/2007 | F24C 15/006 |

OTHER PUBLICATIONS

Partial European Search Report dated Nov. 25, 2015 from European Patent Application No. 15179350.2, 6 pages.

United States Office Action dated Feb. 7, 2017 in co-pending U.S. Appl. No. 14/806,945.

United States Notice of Allowance dated Jun. 8, 2017 in co-pening U.S. Appl. No. 14/806,945.

U.S. Appl. No. 14/806,945, filed Jul. 23, 2015, Dong Jin Oh, et al., Samsung Electronics Co., LTD.

Extended European Search Report dated Jan. 27, 2016 in European Patent Application No. 15178933.6.

European Intention to Grant dated Sep. 15, 2017 in corresponding European Patent Application No. 15 178 933.6.

* cited by examiner

OVEN AND DOOR ASSEMBLY APPLIED TO THE OVEN

CROSS-REFERENCE TO RELATED APPLICATIONS

This application is related to, and claims the priority benefit of Korean Patent Application No. 10-2014-0098899, filed on Aug. 1, 2014 in the Korean Intellectual Property Office, the disclosure of which is incorporated herein by reference.

BACKGROUND

1. Field

Embodiments of the present invention relate to an oven having a door that opens and closes a cooking chamber and has an improved cooling structure.

2. Description of the Related Art

Ovens are cooking utensils for sealing and heating ingredients to cook, and generally, classified into an electric type, a gas type, and an electronic type, depending on a heat source thereof. Electric ovens use an electric heater as a heat source. Gas ovens and microwave ovens heat respectively using gases and frictional heat of water molecules caused by high frequencies.

Ovens include a cooking chamber for cooking foods and may include a component mounting chamber for housing electric components. During a process of cooking food, the inner side of the cooking chamber may be sealed so that heat at a high temperature does not dissipate to the outside. Inside the sealed cooking chamber, contaminants such as grease spots may occur and may be attached to an inner wall of the cooking chamber.

To remove residual contaminants in the cooking chamber, ovens may include a cleaning system. A cleaning systems may include a method of removing contaminants attached to inner walls of the cooking chamber and a front door using high-temperature heat inside the cooking chamber. To remove contaminants attached to inner walls of the sealed cooking chamber and the front door, a temperature inside the cooking chamber from 400 to about 500° C. may be provided.

Ovens may include an insulating and cooling configuration that does not allow the high-temperature heat inside the cooking chamber to be transferred to an outer surface thereof. In the insulation and cooling configuration, a door of an oven may allow air from outside of the door to circulate in an inner space and to decrease a temperature of an outer surface of the door. However, the outside air flowing into the inner space of the door may have an effect not only on the outer surface of the door but also on an inner surface thereof.

A door that opens and closes the cooking chamber at the front of the oven may include a handle installed at the front thereof. A handle may include a grip portion protruding outward. However, in consideration of aesthetics, a handle may be formed inside a door.

SUMMARY

It is an aspect of the present invention to provide an oven having an improved configuration capable of efficiently cleaning inner walls of a cooking chamber and an inner side of a door and an assembly applied to the oven using a high temperature inside the cooking chamber.

It is an aspect of the present invention to provide an oven having an improved configuration capable of cooling an outer side of a door of the oven while an inner side of the door maintains a temperature of inner walls of a cooking chamber, and a door assembly applied to the oven.

It is an aspect of the present invention to provide an oven having an improved configuration capable of efficiently cooling a temperature of a handle formed toward the inside of the oven and a door assembly applied to the oven.

Additional aspects of the invention will be set forth in part in the description that follows and, in part, will be obvious from the description, or may be learned by practice of the invention.

In accordance with an aspect of the present invention, an oven includes a casing, a cooking chamber located inside the casing and having a shape with an open front, and a door assembly having an inner space therein and configured to close and open the open front of the cooking chamber. Herein, the door assembly includes a handle member having a groove concaved inward on a top of the door assembly, an inner plate installed inside the inner space to divide the inner space, a shielding member located between the inner plate and a rear side of the door assembly and configured to shield an air flow, an inlet formed in a bottom of the door assembly and configured to allow an inflow of air from outside of the door into the inner space, and an outlet located on top of the door assembly at the rear of the handle member and configured to provide a space to allow air to move outside the door assembly.

The inner plate may be provided in a position facing the rear side of the door assembly, and a distance between the inner plate and the rear side of the door assembly may be smaller than a distance between the inner plate and a front side of the door assembly.

The front and rear sides of the door assembly and the inner plate may include glass at least partially transparent.

The handle member may include a handle plate bent to the rear from the front side of the door assembly and configured to be coupled with the front plate to form a handle groove. Herein, a bottom of the handle plate may be separate above a top end of the inner plate with a gap.

A distance between a bottom of the handle plate and the top end of the inner plate may be identical to or greater than a distance between a rear side of the handle plate and the rear side of the door assembly.

A distance between the rear side of the handle plate and the rear side of the door assembly may be smaller than a distance between the inner plate and the front side of the door assembly.

The shielding member may have a shape configured to surround an edge area of a space between the inner plate and the rear side of the door assembly.

The shielding member may extend along a bottom of the inner plate and may shield an inflow of air outside of oven between the inner plate and the rear side of the door assembly.

The oven may further include a cooling fan unit including a cooling fan located between the casing and a top of the cooking chamber and a cooling fan flow path extending from the cooling fan to a front of the oven. Herein, the outlet may be located in a position facing the cooling fan flow path.

In accordance with an aspect of the present invention, an oven including a heat cleaning mode in which inner walls of a cooking chamber and an inner side of a door assembly facing the cooking chamber are cleaned using a high temperature inside the cooking chamber includes a casing, the cooking chamber located inside the casing and having a shape with an open front, and the door assembly comprising at least one flow path in inner space and configured to open and close the open front of the cooking chamber. Herein, the door assembly includes a handle member having a groove concaved inward on a top of the door assembly, an inlet formed in a bottom of the door assembly and configured to allow an air inflow into an inner space, an outlet located on top of the door assembly at the rear of the handle member and configured to provide a space to allow air to move outside the door assembly, a first flow path formed in a position facing the rear side of the door assembly and configured to provide a space to allow air to move from a bottom of the door assembly to a top of the door assembly, a second flow path formed in front of the first flow path while being separate from the first flow path and configured to provide a space to allow air to move from the bottom of the door assembly to the top of the door assembly, a third flow path formed between the rear side of the handle member and the rear side of the door assembly and connected to the outlet, and a shielding member installed inside the first flow path and shielding an air inflow inside the first flow path.

A first distance of the first flow path may be smaller than a second distance of the second flow path.

A third distance of the third flow path may be smaller than a second distance of the second flow path.

The shielding member may have a tetragonal shape configured to shield all of a top, a bottom, and both sides of the first flow path.

The shielding member may be located on a bottom of the first flow path and may be configured to shield the first flow path.

The door assembly may further include an inner plate configured to divide the first flow path together with the rear side of the door assembly and a fourth flow path formed between the inner plate and a bottom of handle member and configured to connect the second flow path to the third flow path. The fourth flow path may have a fourth distance between the inner plate and a bottom of the handle member, the fourth distance identical to or greater than the third distance of the third flow path.

The front and rear sides of the door assembly and the inner plate may include glass at least partially transparent.

The handle member may include a handle plate bent to the rear from the front side of the door assembly and configured to be coupled with the front plate to form a handle groove. A bottom of the handle plate may be separate above a top end of the inner plate with a gap.

The oven may include a cooling fan unit including a cooling fan located between the casing and a top of the cooking chamber and a cooling fan flow path extending from the cooling fan to a front of the oven. The outlet may be located in a position facing the cooling fan flow path.

In accordance with an aspect of the present invention, a door assembly including a handle member having a groove shape concaved inward from a top and configured to open and close a cooking chamber of an oven includes an inner plate installed in an inner space of the door assembly and configured to divide the inner space, a shielding member located between the inner plate and a rear side of the door assembly and configured to shield an air inflow, an inlet formed in a bottom of the door assembly and configured to allow an inflow of air from outside of the door into the inner space, and an outlet located on top of the door assembly at the rear of the handle member and configured to provide a space to allow air to move outside the door assembly.

The inner plate may be located facing the rear side of the door assembly, and a distance between the inner plate and the rear side of the door assembly may be smaller than a distance between the inner plate and a front side of the door assembly.

The shielding member may have a shape configured to surround an edge area of a space formed between the inner plate and the rear side of the door assembly.

The handle member may include a handle plate bent backward from the front side of the door assembly and configured to be coupled with the front side of the door assembly to form a handle groove. A bottom of the handle plate may be separate above a top end of the inner plate with a gap.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
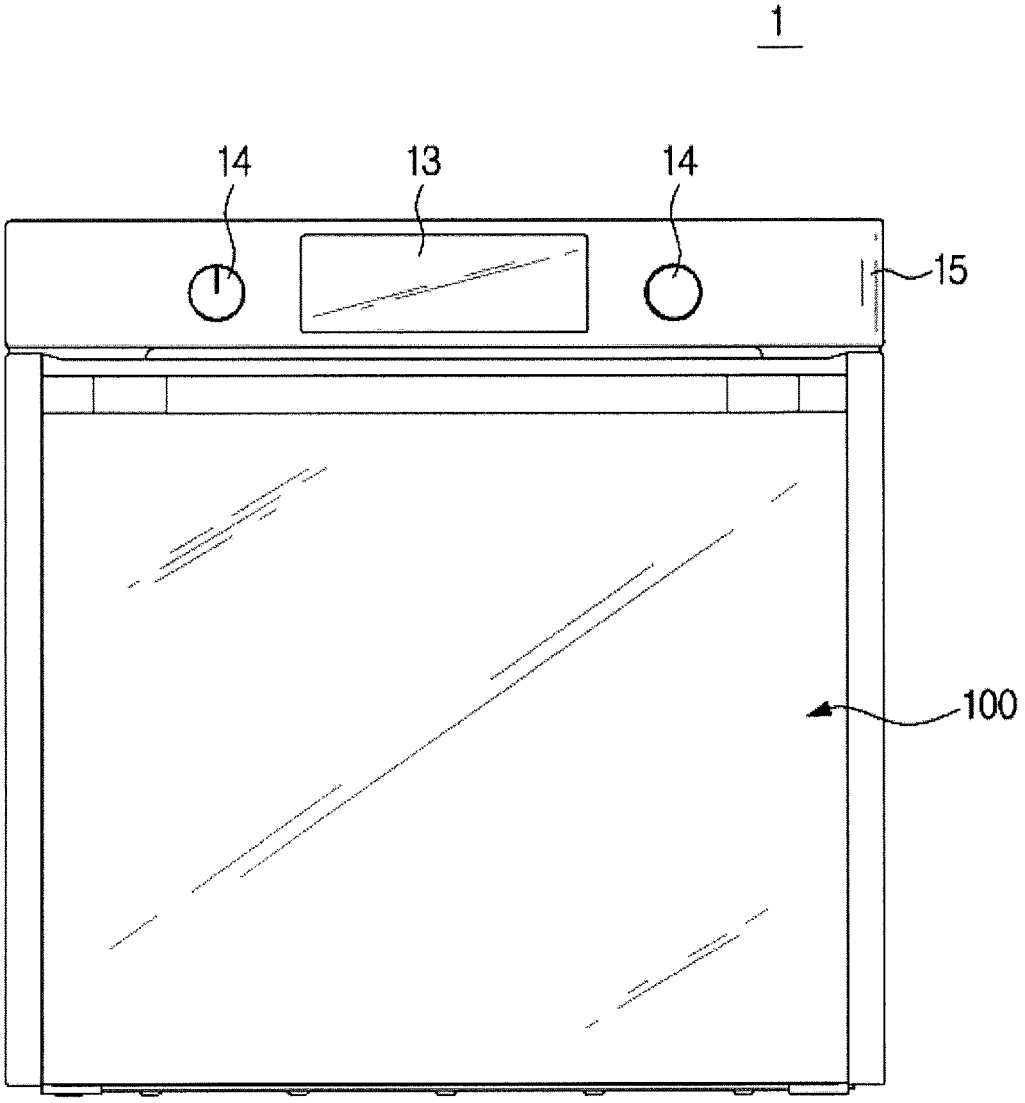
FIG. 1 is a front view of an oven in accordance with an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

Hereinafter, exemplary embodiments of the present invention will be described in detail with reference to the attached drawings.

Figure 2:
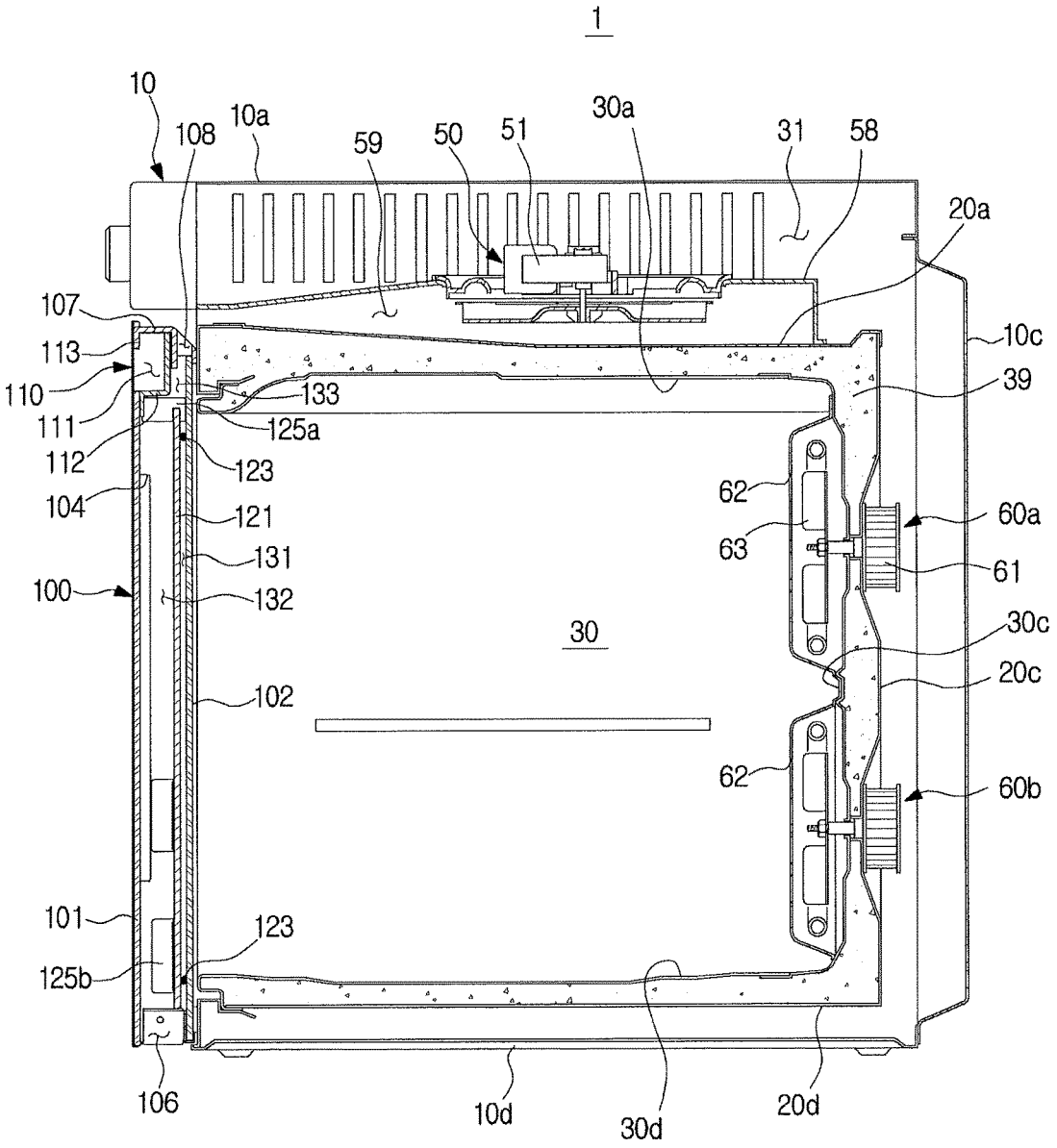
FIG. 2 is an exemplary side cross-sectional view of an oven of FIG. 1.

FIG. 1 is a front view of an oven in accordance with a embodiment of the present invention, and FIG. 2 is a side cross-sectional view of the oven in accordance with an embodiment of the present invention.

As illustrated in FIGS. 1 and 2, the oven 1 includes a casing 10 that forms an exterior and a cooking chamber 30 located inside the casing 10.

The casing 10 may include a rear casing 10*c* provided on the rear side thereof, side casings (not illustrated) provided on both sides thereof and a top casing 10*a* provided on the top side thereof, and a bottom casing 10*d* that may be coupled with a bottom surface. The casing 10 may include a hole (not illustrated) provided in at least a part thereof to allow an inflow of air from outside of the door into the casing 10.

The cooking chamber 30, to form a box shape, includes a cooking chamber top plate 30*a* that forms a top surface, cooking chamber side plates (not illustrated) that form both sides, a cooking chamber rear plate 30*c* that forms a rear surface, and a cooking chamber bottom plate 30*d* that forms a bottom surface. The cooking chamber 30 may allow the front surface thereof to be open in order to put in/take out ingredients to be cooked.

On the top of the cooking chamber 30, there may be provided a component mounting chamber 31 in which electric components (not illustrated), such as a circuit board, etc., may be installed. A control panel 15 that forms the component mounting chamber 31 may include a display 13 to display types of operation information of the oven 1 and a control unit 14 to manipulate the operation of the oven 1.

A rack (not illustrated) may be installed inside the cooking chamber 30 to put ingredients thereon. A plurality of supporters (not illustrated) to allow the rack to be mounted thereon may be provided. The plurality of supporters may be provided to protrude from a left sidewall and a right sidewall of the cooking chamber 30.

One or more circulating fan units 60 may be coupled with the cooking chamber rear plate 30*c*. According to an embodiment, two circulating fan units 60 may be coupled with the cooking chamber rear plate 30*c*. Each of the circulating fan units 60 includes a circulating motor 61 and a circulating fan 63. A circulating fan cover 62 having a panel shape may be coupled in front of the circulating fan 63. The circulating fan cover 62 may include a vent portion (not illustrated). Accordingly, a fluid passing through the circulating fan 63 may be transferred into the cooking chamber 30 through the vent portion.

Inside the component mounting chamber 31, a cooling fan unit 50 to cool a temperature inside the component mounting chamber 31 may be installed. The cooling fan unit 50 suctions outside air into the component mounting chamber 31 and discharges the air toward the front of the oven 1.

The cooling fan unit 50 may include a cooling fan 51 and a cooling fan housing 58 coupled with a top of a top panel 20*a*. The cooling fan 51 may be coupled with one side of the cooling fan housing 58 and may transfer air inside the component mounting chamber 31 to the inside of the cooling fan housing 58. The cooling fan housing 58 may include a cooling fan flow path 59 therein. The cooling fan flow path 59 may be extended from the cooling fan 51 to the front of the oven 1. The cooling fan flow path 59, which has an open front, allows the air inside the cooling fan housing 58 to be discharged through the open front.

The cooking chamber 30 and the cooling fan unit 50 may be connected to each other through an additional flow path (not illustrated). During a cooking process, at least a part of the fluid inside the cooking chamber 30 flows into the cooling fan unit 50 through a flow path (not illustrated) and may be discharged toward the front of the oven 1.

A panel 20 may be located between the casing 10 and the cooking chamber 30. The panel 20 may be disposed to be separate from the casing 10. Accordingly, a flow path through which air may flow may be formed between the casing 10 and the panel 20.

The panel 20 may include a rear panel 20*c* disposed to face the cooking chamber rear plate 30*c*, side panels (not illustrated) disposed to face the cooking chamber side plates, and a top panel 20*a* disposed to face the cooking chamber top plate 30*a*. In at least a part of the panel 20, at least one slit (not illustrated) configured to allow air to move along an outer surface of the panel 20 may be formed.

An insulator 39 may be provided between the cooking chamber 30 and the panel 20. A gap between the cooking chamber top plate 30*a* and the top panel 20*a*, a gap between the cooking chamber rear plate 30*c* and the rear panel 20*c*, gaps between the cooking chamber side plates and the side panels, and a gap between the cooking chamber bottom plate 30*d* and the bottom panel 20*d* may be filled with the insulator 39. The insulator 39 prevents heat inside the cooking chamber 30 from being transferred outside the component mounting chamber 31 and the oven 1.

An open front of the cooking chamber 30 may be allowed to be open and closed by a door assembly 100. The door assembly 100 may be coupled with the cooking chamber 30 using hinges to be pivotable up and down on the cooking chamber 30.

Figure 3:
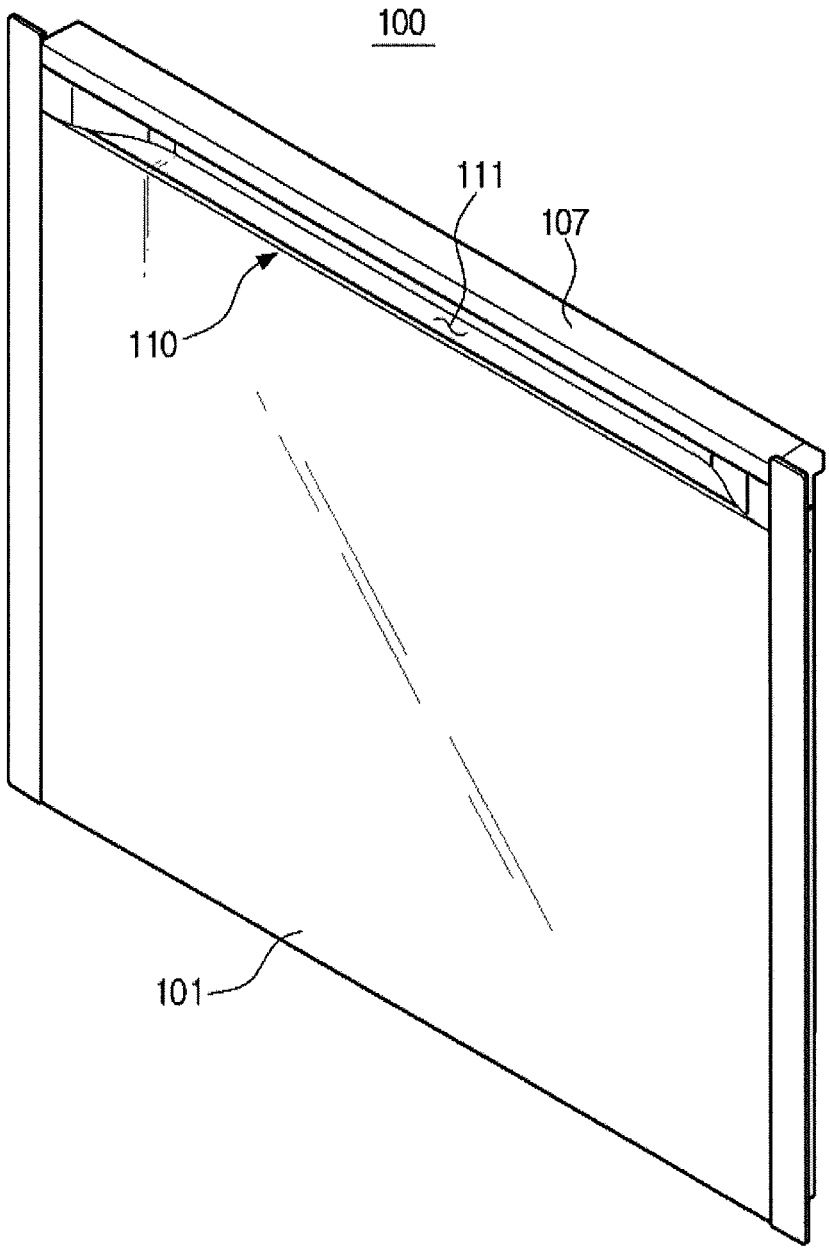
FIG. 3 is an exemplary perspective view illustrating a front side of a door assembly in FIG. 1.
Figure 4:
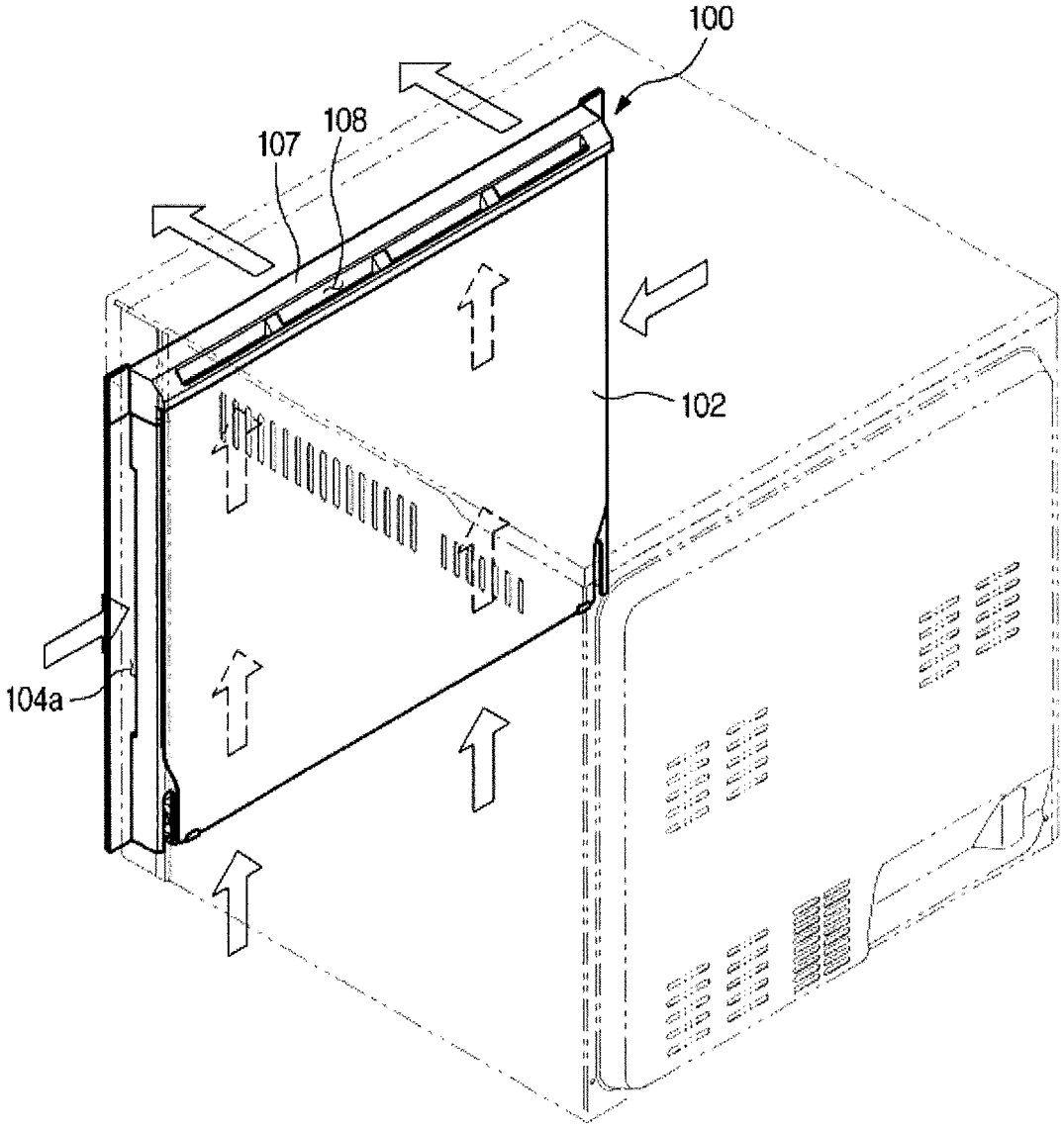
FIG. 4 is an exemplary perspective view illustrating a rear side of the door assembly.
Figure 5:
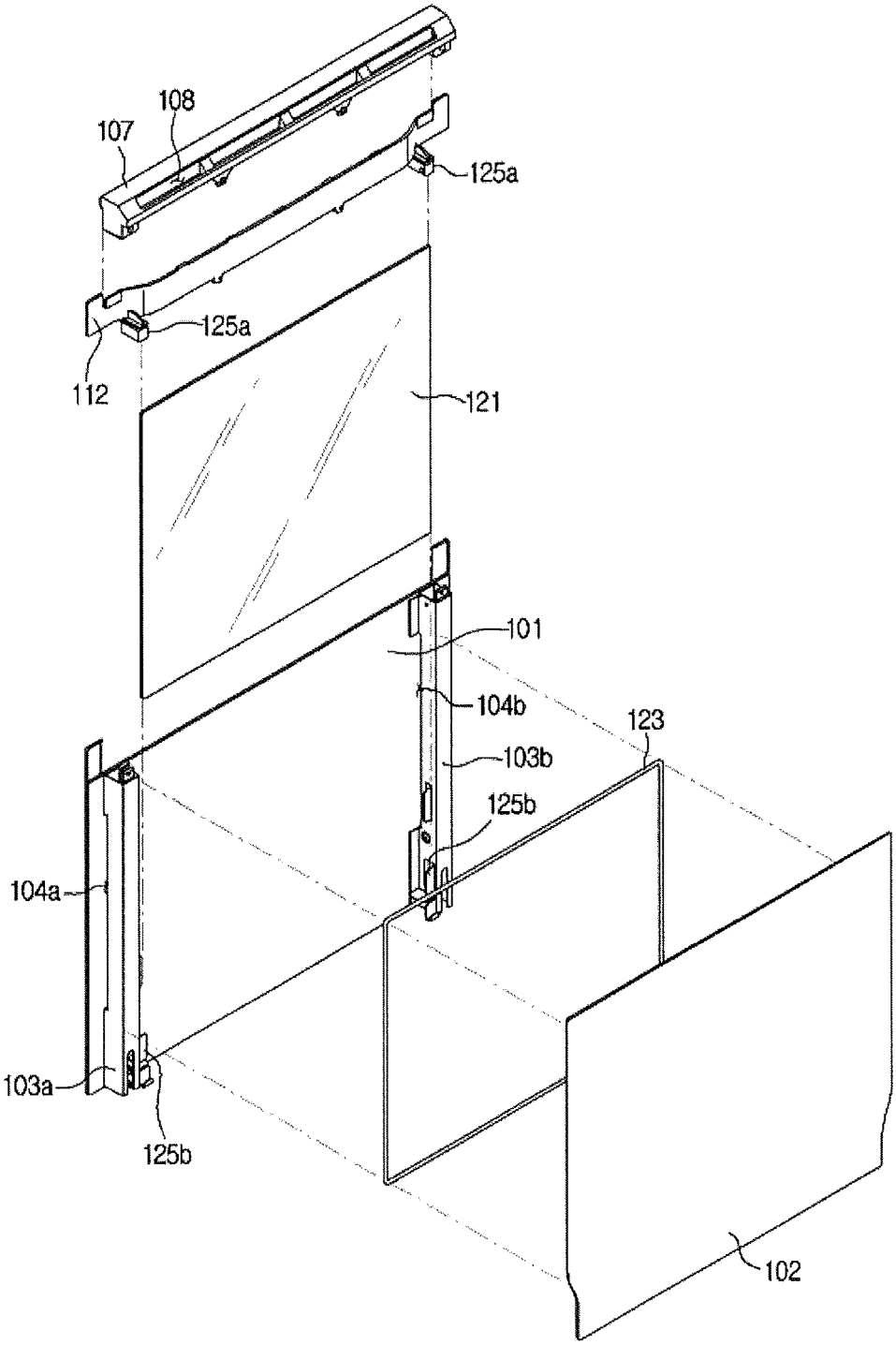
FIG. 5 is an exemplary exploded-perspective view of a configuration of a door assembly.
Figure 6:
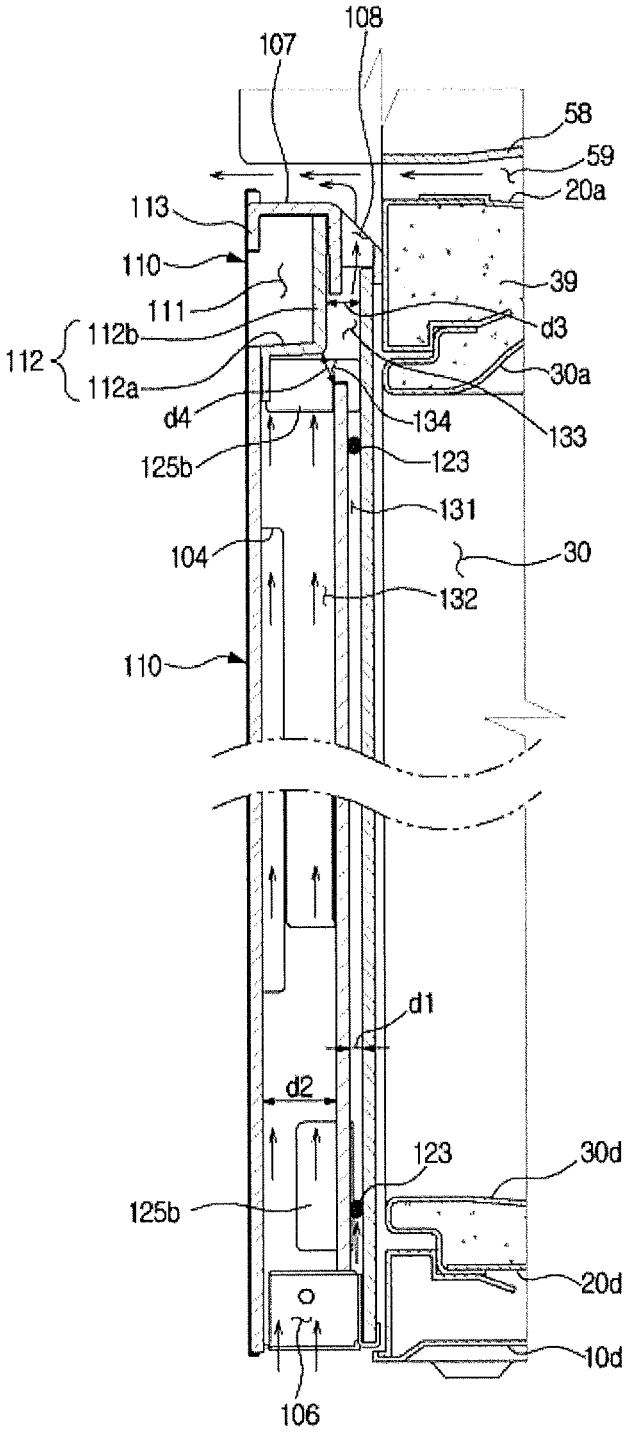
FIG. 6 is an exemplary enlarged side cross-sectional view of a door assembly.

FIG. 3 is a perspective view illustrating the front side of the door assembly 100 according to an embodiment of the present invention, FIG. 4 is a perspective view illustrating an exemplary rear side of the door assembly 100, FIG. 5 is an exploded-perspective view of an exemplary configuration of the door assembly 100, and FIG. 6 is an enlarged exemplary side cross-sectional view of the door assembly 100.

Referring to FIGS. 2 to 6, the door assembly 100 may include a front plate 101, a rear plate 102, and side frames (not illustrated).

The front plate 101 may be provided at a front end of the door assembly 100. The front plate 101 may include glass that may be at least partially transparent.

The rear plate 102 may be provided at a rear end of the door assembly 100. The rear plate 102 may be disposed to be separate behind the front plate 101 with a gap therebetween. The rear plate 102 and the front plate 101 may form an inner space of the door assembly 100. The rear plate 102 may include glass that may be at least partially transparent.

The side frames 103 may be provided on both sides of the inner space formed between the front plate 101 and the rear plate 102. The side frames 103 may be coupled with the front plate 101 and the rear plate 102, respectively, and may be configured to allow the rear plate 102 to be fixedly separate behind the front plate 101 with a gap.

The side frames 103 may include a first side frame 103*a* and a second side frame 103*b*. The first side frame 103*a* and the second side frame 103*b* may face each other and be installed on the left and right between the front plate 101 and the rear plate 102, respectively.

The side frame 103 may include a side inlet 104. The side inlet 104 may serve as a path to allow an inflow of air from outside of the door into the inner space of the door assembly 100 through the side frames 103. As an example, the side inlet 104 may be formed in front of the side frames 103. The side inlet 104 may be formed at a location in which the front plate 101 and the side frames 103 may be in contact with one another and may extend upwardly or downwardly along the front plate 101. The door assembly 100 may allow the inflow of air from outside of the door into the front of the inner space through the side inlet 104.

The side inlet 104 may include a first side inlet 104*a* provided on the first side frame 103*a* and a second side inlet 104*b* provided on the second side frame 103*b*. The first side inlet 104*a* and the second side inlet 104*b* may be opposite to each other.

The door assembly 100 may include a top cover 107. The top cover 107 may be located on a top of the door assembly 100. The top cover 107 may be coupled with each of tops of the front plate 101, the rear plate 102, and the side frames 103, and may cover a top of the inner space of the door assembly 100.

The top cover 107 may include an outlet 108 on one side. As illustrated in FIG. 4, the outlet 108 may be provided on the rear side of the top cover 107. The outlet 108 may include a plurality of holes formed in the rear side of the top cover 107. The plurality of holes of the outlet 108 may be provided at regular intervals at the same height. The outlet 108 may be formed in the top of the top cover 107.

As an example, the outlet 108 may be formed to face the cooling fan flow path 59. The outlet 108 may serve as a path to allow air with a high temperature in the door assembly 100 to be discharged outside the oven 1. The air, which passes through the outlet 108 and moves to the top of the door assembly 100, may be discharged, together with the air discharged from the cooling fan flow path 59, outside the oven 1.

The door assembly 100 may include an inlet 106. The inlet 106 may serve as a path to allow an inflow of air from outside of the door into the door assembly 100. The inlet 106 may be located on a bottom of the door assembly 100. As an example, the inlet 106 may be provided on an open bottom of the door assembly 100.

The door assembly 100 may include a handle member 110. The handle member 110 may be located on an upper portion of the front of the door assembly 100. As an example, the handle member 110 may have a groove shape, which is concaved inward.

The handle member 110 may include a handle plate 112. The handle plate 112 and the front plate 101 may form a grip space 111 toward the inside of the door assembly 100. The handle plate 112 may include a first handle plate 112*a* extending behind the front plate 101 and a second handle plate 112*b* with a gap, which extend vertically and upwardly from the first handle plate 112*a*.

The first handle plate 112*a* may extend toward the inside of the door assembly 100 from a top end of the front plate 101. The second handle plate 112*b* may extend upward from a rear end of the first handle plate 112*a*. The second handle plate 112*b* may extend from the rear end of the first handle plate 112*a* to the top cover 107. As illustrated in FIGS. 5-6, the second handle plate 112*b* may be bent to allow a central part thereof to be located in the rear of both sides thereof. Both sides of the handle plate 112*b* may be coupled with the front plate 101 and a central part of the handle plate 112*b* may be separate behind the front plate 101 with a gap, thereby forming the grip space 111.

The handle member 110 may include a grip part 113. The grip part 113 may allow a user to open or close the door assembly 100. As an example, the grip part 113 extends downward from a front end of the top cover 107. The grip part 113 may be provided on an upper portion of the grip space 111. The grip part 113 may be provided on a lower portion of the grip space 111.

The door assembly 100 may include a flow path 133 at the rear of the handle member 110 in the inner space. The door assembly 100 may include the outlet 108 at the rear of the handle member 110 in the inner space. The flow path 133 and the outlet 108 may cool the handle member 110 by allowing air inside the door assembly 100 to flow. Cooling the door assembly 100 including the handle member 110 is disclosed.

As illustrated in FIGS. 5 and 6, the door assembly 100 may include an inner plate 121. The inner plate 121 may divide the inner space of the door assembly 100. The inner plate 121 may be provided in the inner space of the door assembly 100 to face the rear side of the door assembly 100. The inner plate 121 may be located parallel to the rear plate 102. The inner plate 121 may include glass that is at least partially transparent.

The inner plate 121 and the rear plate 102 may form a first flow path 131. The first flow path 131 may be formed to face the rear plate 102 of the door assembly 100 and may provide a space to allow air to flow from a bottom of the door assembly to a top of the door assembly. The first flow path 131 may have a first distance d1 between the inner plate 121 and the rear plate 102.

The inner plate 121 and the front plate 101 may form a second flow path 132. The second flow path 132 may be formed in front of the first flow path 131 and may be separate from the first flow path 131. The second flow path 132 may provide a space to allow air to flow from the bottom of the door assembly to the top of the door assembly. The second flow path 132 may have a second distance d2 between the inner plate 121 and the front plate 101. As an example, the second distance d2 of the second flow path 132 may be greater than the first distance d1 of the first flow path 131. In other words, the first distance d1 between the inner plate 121 and the rear plate 102 of the door assembly 100 may be smaller than the second distance d2 between the inner plate 121 and the front plate 101 of the door assembly 100.

The door assembly 100 may include a third flow path 133 therein. The third flow path 133 may be formed between the rear side of the handle member 110 and the rear side of the door assembly 100. One side of an upper portion of the third flow path 133 may be connected to the outlet 108. The third flow path 133 may serve as a path to allow air moving through the first flow path 131 and the second flow path 132 to move outside the door assembly 100 through the outlet 108.

The third flow path 133 may have a third distance d3. The third flow path 133 may have the third distance d3 between the rear side of the handle member 110 and the rear side of the door assembly 100. As an example, the third distance d3 of the third flow path 133 may be smaller than the second distance d2 of the second flow path 132. In other words, the third distance d3 between a rear side of the handle plate 112 and the rear plate 102 of the door assembly 100 may be smaller than the second distance d2 between the inner plate 121 and the front plate 101 of the door assembly 100.

The door assembly 100 may include a fourth flow path 134 therein. The fourth flow path 134 may be formed between the inner plate 121 and a bottom of the handle member 110. The fourth flow path 134 may connect the second flow path 132 to the third flow path 133.

The fourth flow path 134 may have a fourth distance d4. The fourth flow path 134 may have the fourth distance d4 between the inner plate 121 and the bottom of the handle member 110. As an example, the fourth distance d4 may be identical to, or greater than, the third distance d3.

The door assembly 100 may further include a holder 125*a* and 125*b*. The holder 125*a* and 125*b* may fix the inner plate 121 inside the door assembly 100. The holder 125*a* and 125*b* may include top holders 125*a* and bottom holders 125*b*.

The top holders 125*a* may be installed on both sides of the bottom of the top cover 107, respectively. The top holder 125*a* may fixedly grip both sides of the bottom of the top cover 121.

The bottom holders 125*b* may be installed on bottoms of the first side frame 103*a* and the second side frame 103*b*, respectively. The bottom holder 125*b* may fixedly grip both sides of the bottom of the inner plate 121.

Figure 7:
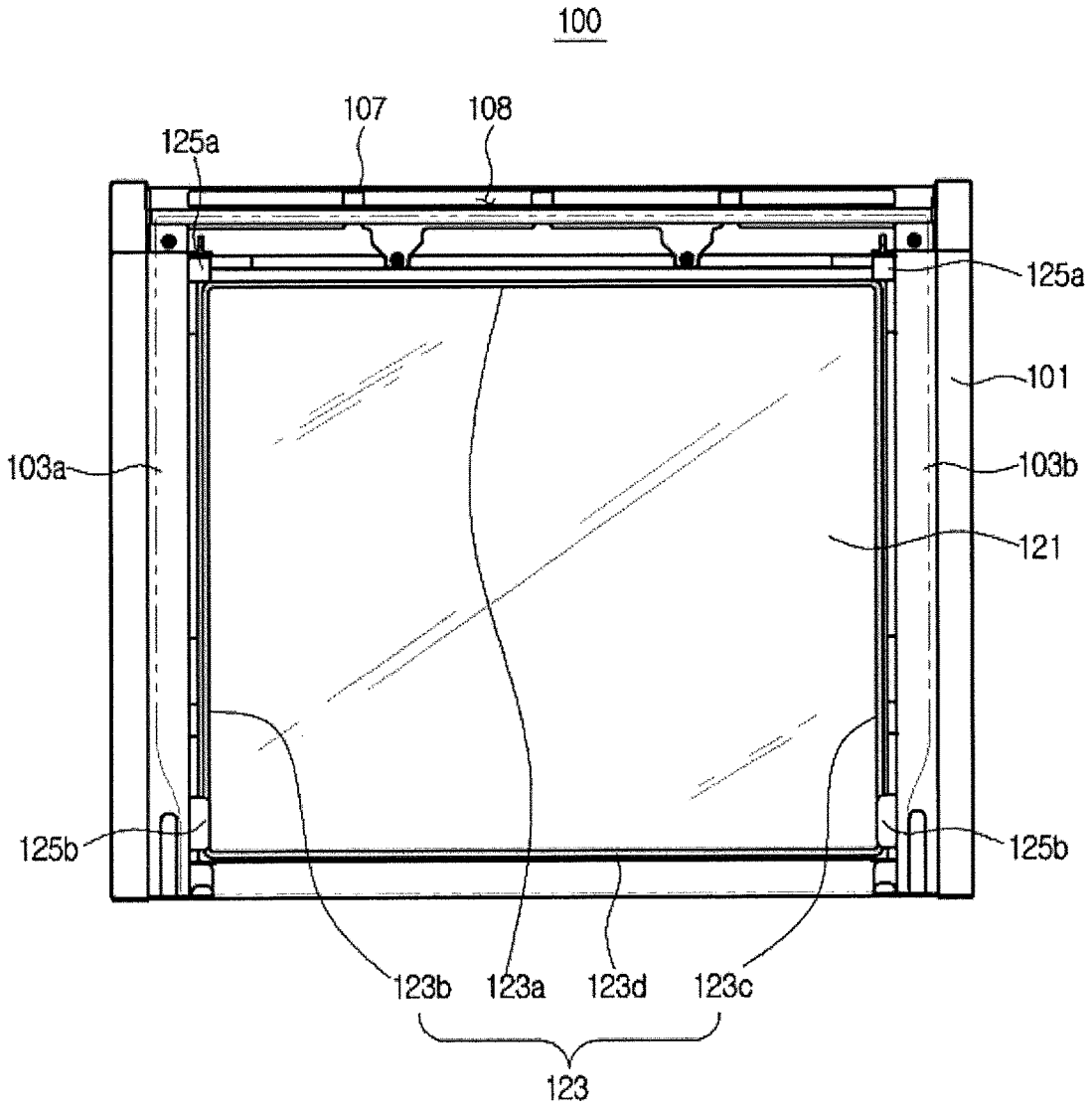
FIG. 7 is a view illustrating a state in which a shielding member is coupled with the inner side of the door assembly in accordance with an embodiment of the present invention.

FIG. 7 is a view illustrating an exemplary state in which a shielding member 123 is coupled with the inner side of the door assembly 100.

Referring to FIGS. 5 and 7, the door assembly 100 may include the shielding member 123.

The shielding member 123 may be located between the inner plate 121 and the rear plate 102 of the door assembly 100. The shielding member 123 may prevent an inflow of air from outside of the door into a gap between the inner plate 121 and the rear plate 102 of the door assembly 100. The shielding member 123 may be located on the first flow path 131 and may prevent a flow of the air from passing through the first flow path 131.

As illustrated in FIG. 7, the shielding member 123 may have a tetragonal shape. The shielding member 123 may extend along an edge area of the inner plate 121. The shielding member 123 may surround an edge area of a space formed between the inner plate 121 and the rear plate 102 of the door assembly 100. The shielding member 123 may have a tetragonal shape to shield a top, a bottom, and both sides of the first flow path 131. The shielding member 123 may extend to be in contact with each of the four holders 125*a* and 125*b* located on the first flow path 131. The shielding member 123 may include a first shielding member 123*a* to shield the top of the first flow path 131, a second shielding member 123*b* to shield one side of the first flow path 131, a third shielding member 123*c* to shield the other side of the first flow path 131, and a fourth shielding member 123*d* to shield the bottom of the first flow path 131. Although not illustrated, the four holders 125*a* and 125*b* located on the first flow path 131 may include a fixing part to fixedly grip the shielding member 123.

The shielding member 123 may shield all of the top, the bottom, and both sides of the first flow path 131. The shielding member 123 may prevent air flowing through the inlet 106 of the door assembly 100 from flowing into the first flow path 131 by shielding the bottom of the first flow path 131. The shielding member 123 may prevent air flowing through the side inlet 104 of the door assembly 100 from flowing into the first flow path 131 by shielding the both sides of the first flow path 131. The shielding member 123 may prevent air inside the first flow path 131 from moving outward from the door assembly 100 by shielding the top of the first flow path 131.

Figure 8:
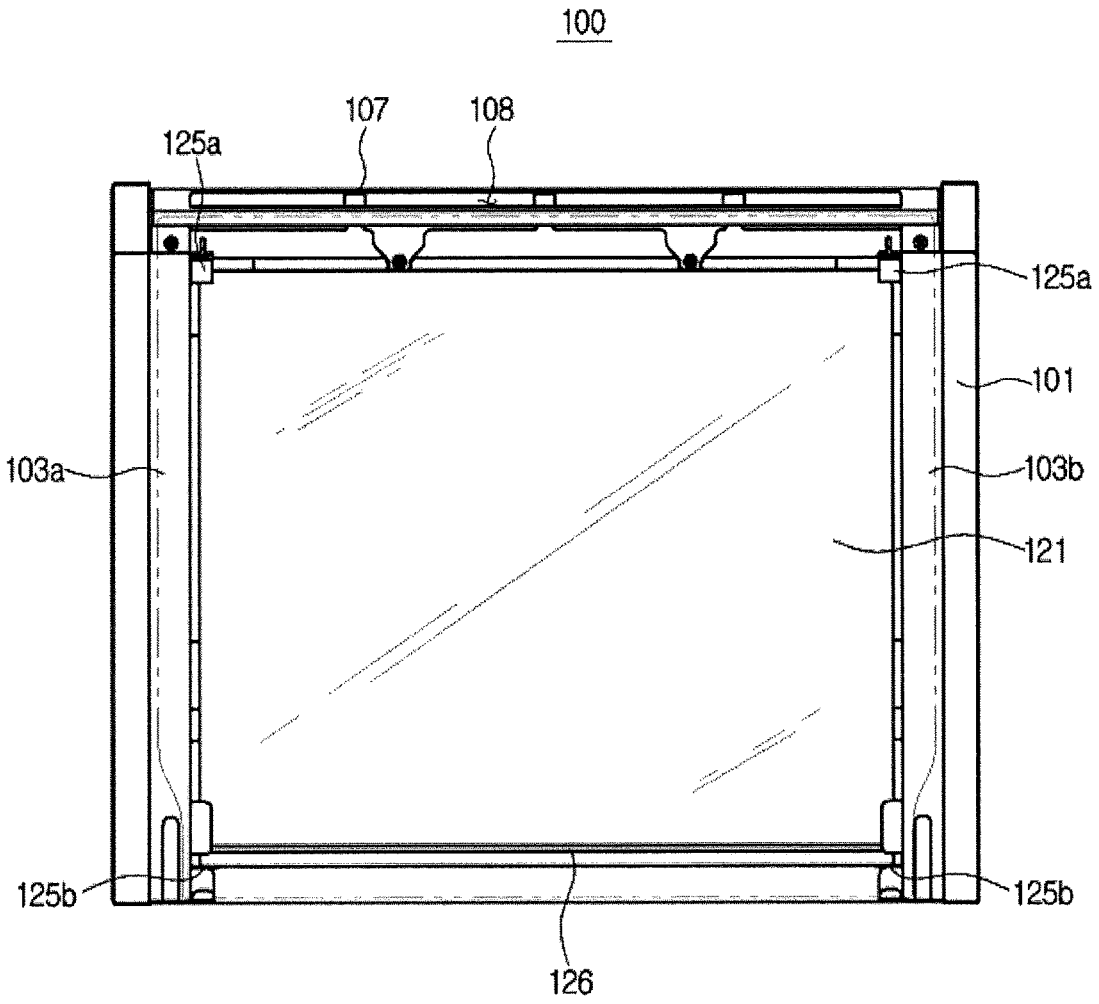
FIG. 8 is an exemplary view illustrating a first modified example of a shielding member of FIG. 7.

FIG. 8 is a view illustrating an exemplary first modified example of the shielding member 123 of FIG. 7.

Referring to FIG. 8, a shielding member 126 may extend along the bottom of the inner plate 121 in the space between the inner plate 121 and the rear plate 102 of the door assembly 100. The shielding member 126 may be located to shield the bottom of the first flow path 131. The shielding member 126 may extend from the bottom holder 125*b*. The shielding member 126 may prevent air flowing from the open bottom of the door assembly 100 from flowing into the first flow path 131.

Figure 9:
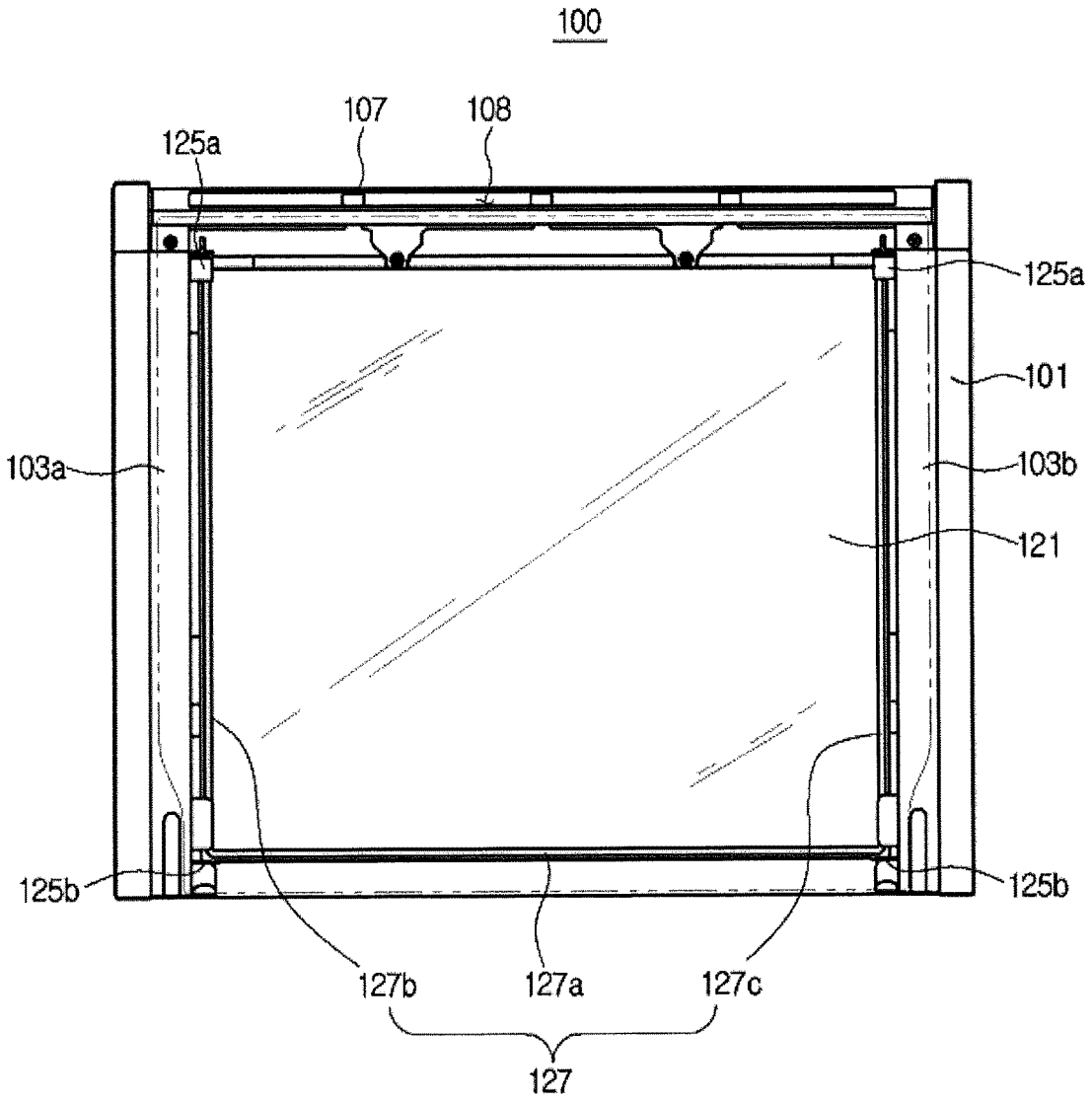
FIG. 9 is an exemplary view illustrating a second modified example of a shielding member of FIG. 7.

FIG. 9 is a view illustrating an exemplary second modified example of the shielding member 123.

Referring to FIG. 9, a shielding member 127 may extend along the bottom and both sides of the inner plate 121 in the space between the inner plate 121 and the rear plate 102 of the door assembly 100. The shielding member 127, compared with the shielding member 123 of FIG. 7, may have a shape with an open top. The shielding member 127 may be located to shield the bottom and both sides of the first flow path 131. The shielding member 127 may include a first shielding member 127*a* to shield the bottom of the first flow path 131, a second shielding member 127*b* to shield one side of the first flow path 131, and a third shielding member 127*c* to shield the other side of the first flow path 131. The shielding member 127 may have a shape to which the top holders 125*a* and the bottom holder that vertically face each other are connected and bottom holders 125*b* on both sides are connected. The shielding member 127 may prevent air flowing from the open bottom of the door assembly 100 and flowing through the side inlet 104 from flowing into the first flow path 131.

Figure 10:
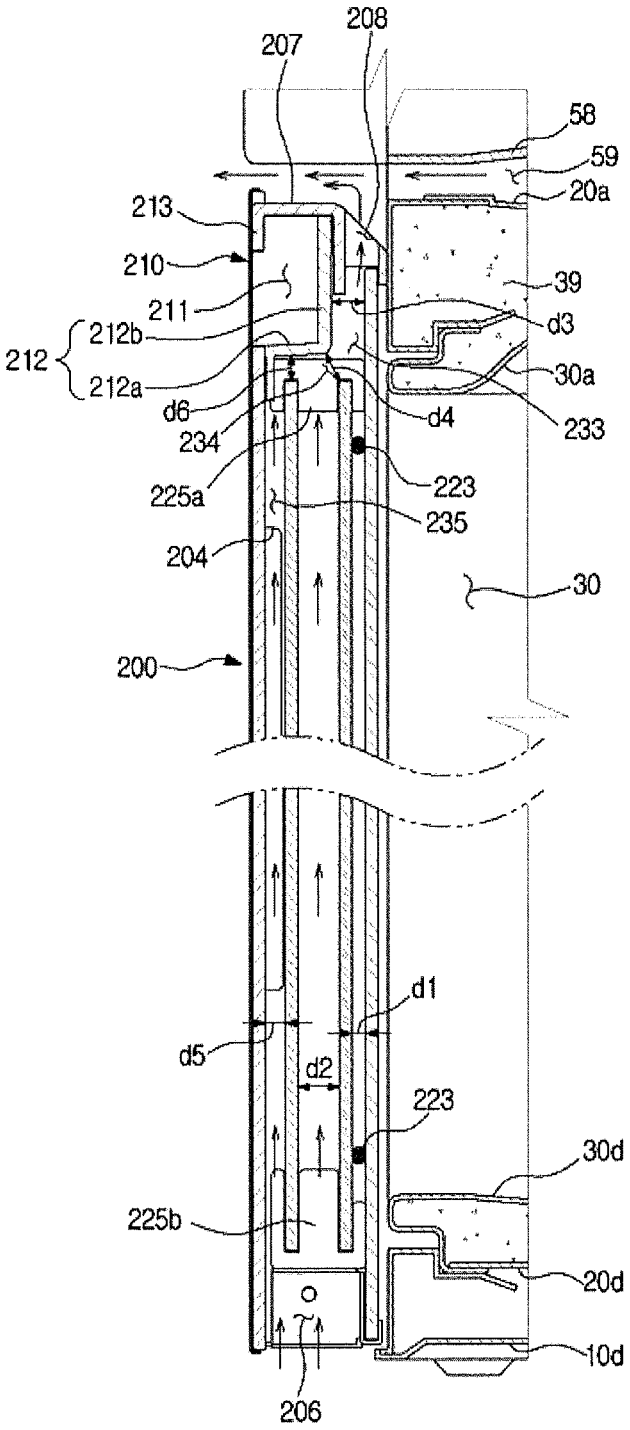
FIG. 10 is a side cross-sectional view of a door assembly in accordance with an embodiment of the present invention.

FIG. 10 is an enlarged side cross-sectional view of a door assembly 200 in accordance with an embodiment of the present invention.

Referring to FIG. 10, the door assembly 200, compared with the door assembly 100 of FIG. 2, includes a plurality of inner plates 221 and 222 in an inner space thereof. Since the plurality of inner plates 221 and 222 are provided in the inner space, the door assembly 200 has a different flow path connecting an inlet 206 to an outlet 208. Differences between the door assembly 200 and the door assembly 100 are described and a repetitive description is omitted.

The door assembly 200, similar to the door assembly 100, may include a front plate 201, a rear plate 202, side frames 203, a top cover 207, and a handle member 210. The door assembly 200 may include the inlet 206 on a bottom of the door assembly and the outlet 208 on a top of the door assembly. The outlet 208 may be provided at the rear of the handle member 210.

The door assembly 200 may include a first inner plate 221 and a second inner plate 222. The first inner plate 221 may be provided in an inner space of the door assembly 200 to face the rear plate 202 of the door assembly 200. The first inner plate 221 may be located parallel to the rear plate 202. The first inner plate 221 may include glass at least partially transparent.

The first inner plate 221 and the rear plate 202 may form a first flow path 231. The first flow path 231 may be formed to face the rear plate 202 of the door assembly 200 and may provide a space to allow air to flow from a bottom of the door assembly to a top of the door assembly. The first flow path 231 may have a first distance d1 between the first inner plate 221 and the rear plate 202.

The second inner plate 222 may be located between the first inner plate 221 and the front plate 201 in the inner space of the door assembly 200. The second inner plate 222 may divide a space between the first inner plate 221 and the front plate 201 of the door assembly 200. The second inner plate 222 may be provided parallel to the first inner plate 221. The second inner plate 222 may include glass at least partially transparent.

The second inner plate 222 and the first inner plate 221 may form a second flow path 232. The second flow path 232 may be formed in front of the first flow path 231 while being separate from the first flow path 231. The second flow path 232 may provide a space to allow air to flow from a bottom of the door assembly to a top of the door assembly. The second flow path 232 may have a second distance d2 between the first inner plate 221 and the second inner plate 222.

The second inner plate 222 and the first inner plate 221 may form a fifth flow path 235. The fifth flow path 235 may be formed in front of the second flow path 232 while being separate from the second flow path 232. The fifth flow path 235 may have a fifth distance d5 between the second inner plate 222 and the front plate 201.

The second inner plate 222 may have a distance d6 between a top end thereof and a bottom of the handle member 210. Through this, the fifth flow path 235 may be connected to a third flow path 233 and a fourth flow path 234, which will be described below.

The door assembly 200 may include the third flow path 233. The third flow path 233 may be formed between the rear side of the handle member 210 and the rear side of the door assembly 200. One side of an upper portion of the third flow path 233 may be connected to the outlet 208. The third flow path 233 may serve as a path to allow air moving through the first flow path 231 and the second flow path 232 to move outside the door assembly 200 through the outlet 208.

The third flow path 233 may have a third distance d3. The third flow path 233 may have the third distance d3 between the rear side of the handle member 210 and the rear side of the door assembly 200. As an example, the third distance d3 of the third flow path 233 may be smaller than the second distance d2 of the second flow path 232. In other words, the third distance d3 between a rear side of the handle plate 212 and the rear plate 202 of the door assembly 200 may be smaller than the second distance d2 between the first inner plate 221 and the front plate 201 of the door assembly 200.

The door assembly 200 may further include the fourth flow path 234 therein. The fourth flow path 234 may be formed between the first inner plate 221 and the bottom of the handle member 210. The fourth flow path 234 may connect the second flow path 232 to the third flow path 233.

The fourth flow path 234 may have the fourth distance d4. The fourth flow path 234 may have the fourth distance d4 between the first inner plate 221 and the bottom of the handle member 210. As an example, the fourth distance d4 may be identical to or greater than the third distance d3.

Generally, the oven 1 maintains the inside of the cooking chamber 30 at a high temperature while cooking or cleaning the cooking chamber 30 after the cooking. On other sides except the open front of the cooking chamber 30, the insulator may be provided between the cooking chamber 30 and the panel 20 to insulate the heat of the cooking chamber 30. However, the insulator 39 may not be provided at the door assembly 100 located in front of the cooking chamber 30 to allow air from outside the door to circulate in the inner space.

The air from outside the door may flow into the inner space of the door assembly 100 through the inlet 106. Air in the inner space of the door assembly 100 may move outside the door assembly 100 through the outlet 108. A temperature of the air in the door assembly 100 may increase due to heat exchange with the door assembly 100 at a high temperature. Air at a high temperature may move upward along the inner space of the door assembly 100 and may move outside the door assembly 100 through the outlet 108. The air moving outside through the outlet 108 may move outside the oven 1, together with the air discharged forward from the oven 1 through the cooling fan flow path 59. When the air moves outside through the outlet 108, the air from outside the door may flow into the inner space of the door assembly 100 through the inlet 106. Accordingly, a temperature of the front of the door assembly 100 may decrease.

According to an exemplary embodiment of the present invention, not only a temperature of the front plate 101 of the door assembly 100 but also a temperature of the rear plate 102 of the door assembly 100 may decrease. When contaminants such as grease spots occurring inside the cooking chamber 30 and the rear plate 102 of the door assembly 100 are cleaned using the high temperature of the cooking chamber 30, the temperature of the rear plate 102 of the door assembly 100 becomes decreased, thereby reducing cleaning efficiency.

According to an embodiment of the present invention, a plurality of flow paths 131 and 132 are formed in the inner space of the door assembly 100 and the shielding member 123 is provided in the first flow path 131 facing the rear plate 102 of the door assembly 100, thereby preventing an air flow inside the first flow path 131. Air from outside the door flowing through the inlet 106 may move to the outlet 108 on top through the second flow path 132 and may move outside the door assembly 100 through the outlet 108. Heat exchange may be performed while the air from outside the door may continuously flow through the second flow path 132. Temperatures of the front plate 101, the top cover 107, and the side frames 103 of the door assembly 100 located adjacent to the second flow path 132 may be decreased more than a temperature of the rear plate 102.

Although the handle member 110 may be located in the inner space of the door assembly 100, air flowing upward from the second flow path 132 may pass through the third flow path 133 and may move outside the door assembly 100 through the outlet 108 at the rear of the handle member 110. According to an exemplary process, the handle member 110 may be cooled by heat exchange with the air passing through the third flow path 133. The handle member 110 may maintain a constant temperature while the oven 1 is cooking or cleaning the cooking chamber 30 using a temperature of the cooking chamber 30.

However, since the air flow from the first flow path 131 may be shielded in the rear plate 102 of the door assembly 100, the temperature inside the cooking chamber 30 may be maintained. Accordingly, when being cleaned using the high temperature inside the cooking chamber 30, the inner side of the rear plate 102 of the door assembly 100 may be cleaned identically to inner walls of the cooking chamber 30

According to the embodiment of the present invention, the inner side of the rear plate 102 of the door assembly 100 may maintain a temperature inside of the cooking chamber 30 and the front plate 101, the top cover 107, and the side frames 103 of the door assembly 100 may be cooled by circulation of air from outside of the door to maintain a temperature allowable for the user to touch. Accordingly, cleaning efficiency of the inside of the cooking chamber 30 and the rear plate 102 of the door assembly 100 may increase.

As is apparent from the above description, an oven in accordance with the embodiment of the present invention may increase cleaning efficiency of an inside of a cooking chamber of the oven and an inner side of a door of the oven.

In accordance with an embodiment of the present invention, a configuration of a door assembly is improved to cool an outside of the door assembly and a handle formed therein while maintaining a temperature of an inner side of the door assembly as that of an inside of a cooking chamber.

According to an exemplary embodiment of the present invention, the inner walls of the cooking chamber and the inner side of the door may be efficiently cleaned using a high temperature.

The handle formed toward the inside of the door may be efficiently cooled, thereby increasing user safety.

Although a few embodiments of the present invention have been illustrated and described, it would be appreciated by those skilled in the art that changes may be made in these embodiments without departing from the principles and spirit of the invention, the scope of that is defined in the claims and their equivalents.

What is claimed is:

1. An oven comprising:

a casing;

a cooking chamber located inside the casing and having an open front; and a door assembly having an inner space, the door assembly configured to close and open the open front of the cooking chamber, wherein the door assembly comprises:

a handle member having a groove concaved inward on a top front surface of the door assembly, an inner plate installed inside the inner space of the door assembly to divide the inner space of the door assembly into a front portion and a rear portion and form a first flow path in the rear portion of the inner space of the door assembly between a rear surface of the inner plate and a rear side of the door assembly and a second flow path in the front portion of the inner space of the door assembly between a front surface of the inner plate and a front side of the door assembly, an inlet formed in at least one of a bottom of the door assembly and a side of the door assembly, the inlet configured to allow an inflow of air from an outside of the door assembly into the inner space of the door assembly, a shielding member located between the inner plate and the rear side of the door assembly, and disposed along at least a part of the first flow path, the shielding member being configured to shield at least a part of the inflow of air from the outside of the door assembly from flowing inside the first flow path, an outlet at a top of the door assembly at a rear of the handle member, the outlet configured to allow air to move to the outside of the door assembly, a third flow path formed between the rear side of the handle member and the rear side of the door assembly, the third flow path connected to the outlet, and a fourth flow path formed between the inner plate and a bottom of the handle member, wherein the fourth flow path is formed between the first flow path and the second flow path to prevent air cooling of the front side of the door assembly by passing through the second flow path and flowing toward the third flow path to cool the handle member from being discharged to the outside of the door assembly.

2. The oven of claim 1, wherein a distance between the rear surface of the inner plate and the rear side of the door assembly is smaller than a distance between the front surface of the inner plate and the front side of the door assembly.

3. The oven of claim 2, wherein the front side and the rear side of the door assembly and the inner plate comprise glass at least partially transparent.

4. The oven of claim 1, wherein the handle member comprises a handle plate bent to a rear side of the door assembly from the front side of the door assembly and configured to be coupled with the front side of the door assembly to form a handle groove, and wherein a bottom of the handle plate is located to be separate above a top end of the inner plate with a gap.

5. The oven of claim 4, wherein a distance between the bottom of the handle plate and the top end of the inner plate is identical to or greater than a distance between a rear side of the handle plate and the rear side of the door assembly.

6. The oven of claim 4, wherein a distance between the rear side of the handle plate and the rear side of the door assembly is smaller than a distance between the inner plate and the front side of the door assembly.

7. The oven of claim 1, wherein the shielding member has a shape configured to surround an edge area of a space between the inner plate and the rear side of the door assembly.

8. The oven of claim 1, wherein the shielding member extends along a bottom of the inner plate and is configured to shield the inflow of the air from the outside of the door assembly between the inner plate and the rear side of the door assembly.

9. The oven of claim 1, further comprising a cooling fan located between the casing and a top of the cooking chamber and a cooling fan flow path extending from the cooling fan to a front of the oven, wherein the outlet is located facing the cooling fan flow path.

10. An oven including a heat cleaning mode in which inner walls of a cooking chamber and an inner side of a door assembly facing the cooking chamber are cleanable using a high temperature inside the cooking chamber, the oven comprising:

a casing, wherein the cooking chamber located inside the casing and having an open front; and wherein the door assembly configured to open and close a front of the cooking chamber, and comprising:

a handle member having a groove concaved inward on a top front surface of the door assembly, an inlet formed in a bottom of the door assembly, the inlet configured to allow an air inflow into the inner space of the door assembly, the inner space of the door assembly divided into a front portion and a rear portion by an inner plate, an outlet located on a top of the door assembly at a rear of the handle member, the outlet configured to allow air to move to an outside the door assembly, a first flow path formed in the rear portion of the inner space of the door assembly, the first flow path configured to allow air to move from a bottom of the door assembly to the top of the door assembly, a second flow path formed in the front portion of the inner space of the door assembly in front of the first flow path and separated from the first flow path by the inner plate, the second flow path configured to allow other air to move from the bottom of the door assembly to the top of the door assembly, a third flow path formed between the rear side of the handle member and the rear side of the door assembly, the third flow path connected to the outlet, a shielding member located between the inner plate and the rear side of the door assembly, the shielding member being configured to shield at least a part of an inflow of air from the outside of the door assembly from flowing inside the first flow path, and a fourth flow path formed between the inner plate and a bottom of the handle member, wherein the fourth flow path is formed between the first flow path and the second flow path to prevent air cooling of the front side of the door assembly by passing through the second flow path and flowing toward the third flow path to cool the handle member from being discharged to the outside of the door assembly.

11. The oven of claim 10, wherein a width of the first flow path is smaller than a width of the second flow path.

12. The oven of claim 10, wherein a width of the third flow path is smaller than width of the second flow path.

13. The oven of claim 10, wherein the shielding member has a tetragonal shape configured to shield all of a top, a bottom, and both sides of the first flow path.

14. The oven of claim 10, further comprising a cooling fan located between the casing and a top of the cooking chamber and a cooling fan flow path extending from the cooling fan to a front of the oven, wherein the outlet is located in a position facing the cooling fan flow path.

15. The oven of claim 10, wherein the door assembly further comprises:

the inner plate that divides the inner space of the door assembly into the front portion and the rear portion, and wherein a distance of the fourth flow path between the inner plate and a bottom of the handle member identical to or greater than a distance of the third flow path between the rear side of the handle member and the rear side of the door assembly.

16. The oven of claim 10, wherein the handle member comprises a handle plate bent to the rear side of the door assembly from the front side of the door assembly, the handle plate configured to be coupled with the front side of the door assembly to form a handle groove, wherein a bottom of the handle plate is located to be separate above a top end of the inner plate with a gap.

17. An oven comprising:

a casing;

a heating chamber located inside the casing; and a wall assembly having an inner space, the wall assembly comprising:

a handle member having a groove concaved inward on a top front surface of the wall assembly a plate installed inside the inner space to divide the inner space of the wall assembly into a front portion and a rear portion and form a first flow path in the rear portion of the inner space of the wall assembly between a rear surface of the plate and a rear side of the wall assembly and a second flow path in the front portion of the inner space of the wall assembly between a front surface of the plate and a front side of the wall assembly, an inlet formed in at least one of a bottom of the wall assembly and a side of the wall assembly, the inlet configured to allow an inflow of air from an outside of the wall assembly into the inner space of the wall assembly, a shielding member located between the plate and the rear side of the wall assembly, and disposed between along the first flow path, the shielding member configured to shield at least a part of the inflow of air from the outside of the wall assembly from flowing inside the first flow path, an outlet located in the wall assembly, the outlet configured to allow air to move to the outside of the wall assembly, a third flow path formed between the rear side of the handle member and the rear side of the wall assembly, the third flow path connected to the outlet, and a fourth flow path formed between the plate and a bottom of the handle member, the fourth flow path formed between the first flow path and the second flow path to prevent air cooling of the front side of the wall assembly by passing through the second flow path and flowing toward the third flow path to cool the handle member from being discharged to the outside of the wall assembly.

18. The oven of claim 17, wherein the inflow of air from the outside of the wall assembly is an inflow of air from outside of the oven.

19. A wall assembly of an oven, the wall assembly comprising:

a handle member having a groove concaved inward on a top front surface of the wall assembly, a plate dividing an inner space of the wall assembly into a front portion and a rear portion and forming a first flow path in the rear portion of the inner space of the wall assembly between a rear surface of the plate and a rear side of the wall assembly and a second flow path in the front portion of the inner space of the wall assembly between a front surface of the plate and a front side of the wall assembly;

an inlet in the wall assembly and configured to allow an inflow of air from an outside of the wall assembly into the inner space;

a shielding member disposed between the plate and the rear side of the wall assembly and configured to shield at least a part of the inflow of air from the outside of the wall assembly from flowing inside the first flow path;

an outlet in the wall assembly and configured to allow air to move to the outside of the wall assembly;

a third flow path formed between the rear side of the handle member and the rear side of the wall assembly, the third flow path connected to the outlet; and a fourth flow path formed between the plate and a bottom of the handle member, the fourth flow path formed between the first flow path and the second flow path to prevent air cooling of the front side of the wall assembly by passing through the second flow path and flowing toward the third flow path to cool the handle member from being discharged to the outside of the wall assembly.

20. The wall assembly of claim 19, wherein the inflow of air from the outside of the wall assembly is an inflow of air from outside of the oven.

* * * * *